United States Patent [19]

Schillinger

[11] 4,398,661

[45] Aug. 16, 1983

[54] INTERNALLY DIVIDED CARTON

[75] Inventor: Joseph F. Schillinger, Fulton, Ill.

[73] Assignee: Champion International Corporation, Stamford, Conn.

[21] Appl. No.: 315,934

[22] Filed: Oct. 28, 1981

[51] Int. Cl.[3] ..... B65D 5/48

[52] U.S. Cl. ..... 229/27; 229/15; 206/491

[58] Field of Search ..... 229/27, 39 R, 10, 15; 206/182, 185, 186, 189, 191, 197, 427, 491, 198

[56] References Cited

U.S. PATENT DOCUMENTS

| | | | |
|---|---|---|---|
| 2,325,755 | 8/1943 | Eggebrecht | 229/27 |
| 2,678,724 | 5/1954 | Andriot, Jr. | 229/27 |
| 2,866,588 | 12/1958 | Bolding | 229/27 |
| 2,998,179 | 8/1961 | Zilles | 229/27 |
| 3,199,762 | 8/1965 | Coons | 229/27 |
| 3,365,112 | 1/1968 | Priest et al. | 229/27 |
| 3,403,836 | 10/1968 | Farquhar | 229/15 |
| 3,554,402 | 1/1971 | Lock | 229/27 |
| 3,567,069 | 4/1969 | Harrelson | 206/188 |
| 3,610,511 | 10/1971 | Engdahl, Jr. | 206/198 |
| 4,157,755 | 6/1979 | Gough | 229/27 |
| 4,179,061 | 12/1979 | Gilbert | 229/27 |

*Primary Examiner*—Joseph Man-Fu Moy
*Assistant Examiner*—David Fidei
*Attorney, Agent, or Firm*—Evelyn M. Sommer; William W. Jones; John H. Mulholland

[57] ABSTRACT

The interior of the paperboard carton is subdivided into two equal volumes by means of an internal divider panel which is formed as an extension of one end of the blank which is used to form the carton. The carton has front and back walls, side walls, and top and bottom closure flaps foldably connected to the front, back and side walls. The carton is formed from a one piece blank having opposite ends thereof overlapping each other and glued together at the center of the back wall, the divider panel is formed as an extension of one of the overlapping ends of the blank and is set back on that end of the blank so that the divider panel has basal marginal legs between which there extends a glue tab which is glued to the other end of the blank to form part of the glue seam joining the ends of the blank together. A paperboard material savings is realized by setting the divider panel back to form the marginal legs. The top closure of the carton is medially rupturable so as to be divisable into two top closures independently operable.

2 Claims, 8 Drawing Figures

FIG. 1.
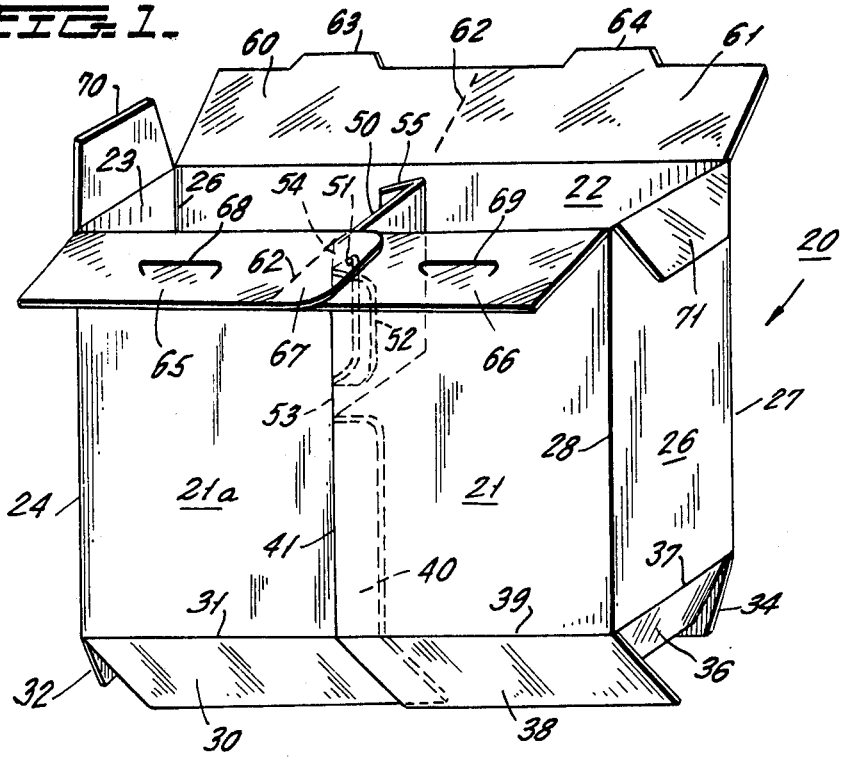
FIG. 3.
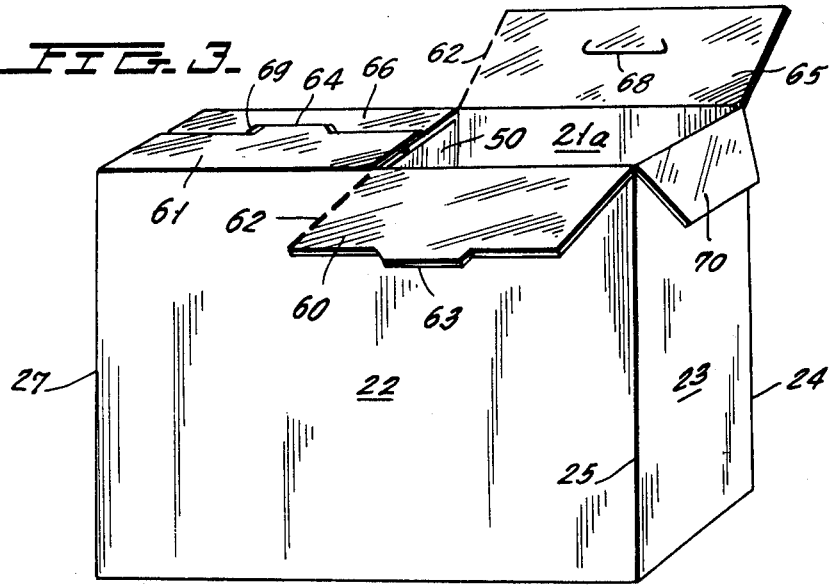
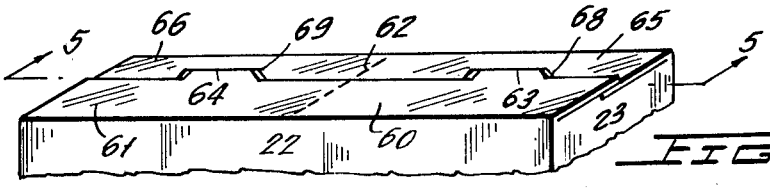
FIG. 2.

FIG. 4.
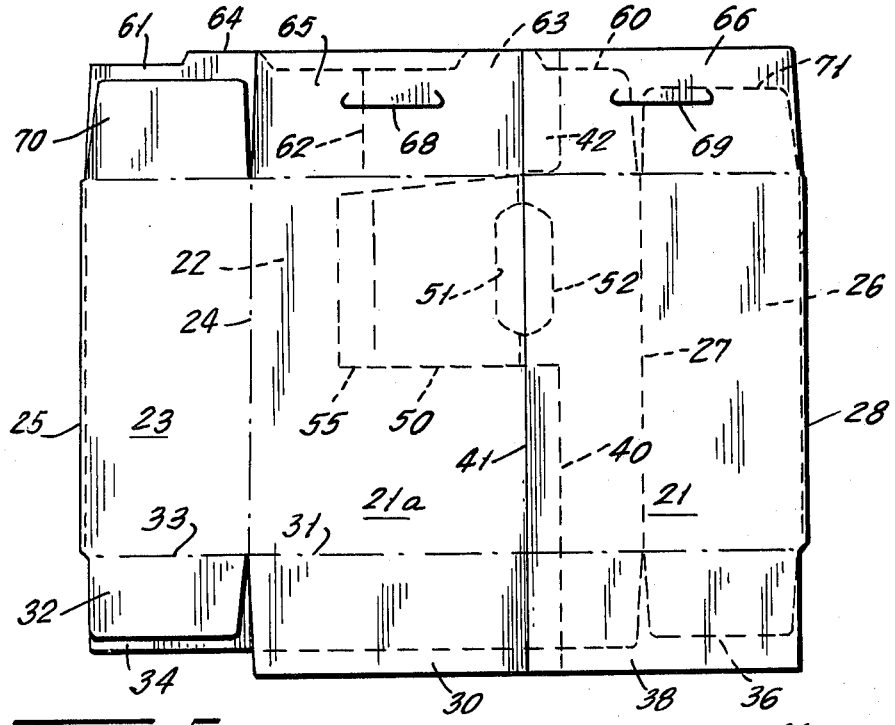
FIG. 5.
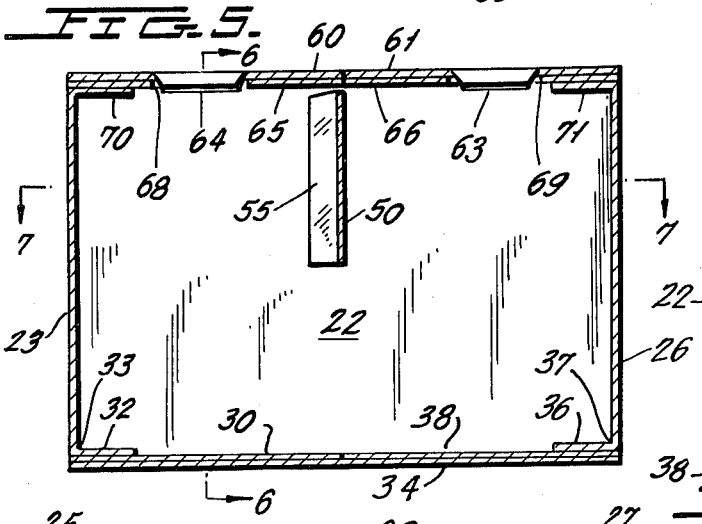
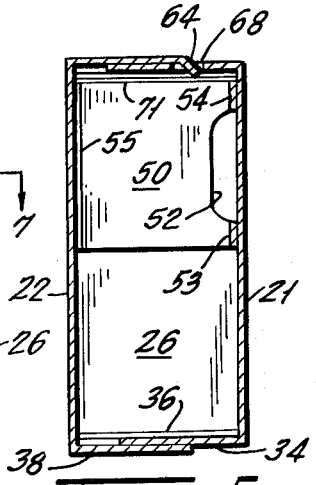
FIG. 6.
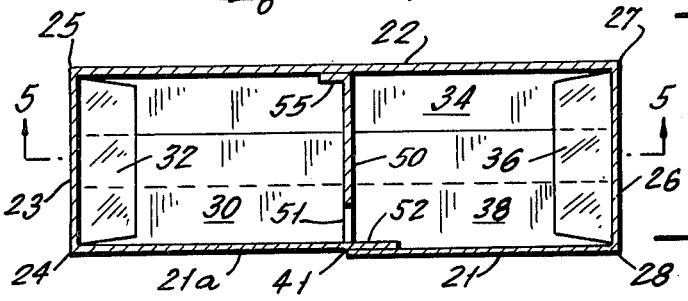
FIG. 7.

55
50
67
51
40
54
52
53
41
68
65
21a
31
30
24
70
23
32
33
25
63
60
34
62
22
35
20a
64
61
27
26
71
37
36
28
69
38
66
21
39

INTERNALLY DIVIDED CARTON

This invention relates to a paperboard carton which has an integral transverse divider panel formed as an extension from one end of the blank from which the carton is formed. More particularly, this invention relates to such a carton which is improved by having the divider panel fold line set back from the free end of the blank whereby a glue tab is formed from divider panel material, the glue tab forming part of the glue seam of the carton whereby a paperboard material savings is effected.

Paperboard cartons are known which include an interior divider panel which divides the interior of the carton into two halves. These cartons are typically narrow cartons having major front and back panels, and minor side panels. Top and bottom closures are formed by folded flaps extending from the front, back and side panels. These cartons are formed from a single blank of paperboard material which has been appropriately cut and scored. Opposite ends of the blank are overlapped interiorly of the front or back panels, preferably the back panel, to form a glue seam to which glue is applied to form the rectangular tube configuration of the carton. The end of the outer overlapped panel extends beyond the mid line of the back panel, and the end of the inner overlapped panel is folded at the mid line of the back panel with the folded part forming the divider panel which extends at right angles to the back panel and terminates in a glue tab which is glued to the inner surface of the front panel. One problem which exists with this type of prior art carton relates to the formation of the overlapped glue seam. When the outer overlapped panel extends past the mid line of the back panel, excessive paperboard material must be utilized in the formation of the blank from which the carton is made. Singularly this excess material is relatively insignificant, however, when multiplied by the hundreds of thousands of such cartons produced annually, the excess material becomes a significant factor in terms of cost.

The improved carton of this invention eliminates the excess material needed for forming the carton blank by terminating the outer overlapped panel at the mid line of the back panel. The inner overlapped panel is provided with a plurality of glue tabs which extend beyond the mid line of the back panel, with one of the glue tabs being cut from the divider panel material. The divider panel is an extension of the inner overlapped panel and is set back to the mid line of the back panel and formed with two marginal legs which are delineated in part by the glue tab cut therefrom. Utilizing a set back divider panel allows the overall length of the blank which is needed to form the carton to be shorter than the prior art blanks, thus reducing the total amount of paperboard material needed to form the blank and carton.

It is, therefore, an object of this invention to provide an improved carton and a blank therefor, which carton has an interior divider panel which divides the interior of the carton into halves.

It is a further object of this invention to provide an improved carton and blank of the character described wherein the divider panel is formed as an integral extension of one end of the blank and foldably connected thereto.

It is an additional object of this invention to provide an improved carton and blank of the character described wherein the divider panel is set back from the end of the blank and a glue tab is cut from the divider panel to form a portion of the glue seam which secures the carton together.

These and other objects and advantages of the invention will become more readily apparent from the following detailed description of a preferred embodiment of a carton and blank formed in accordance with the invention when taken in conjunction with the accompanying drawings, in which:

FIG. 1 is a view in perspective of the carton of the present invention fully erected;

FIG. 2 is a top view of the carton of FIG. 1 in perspective showing the same closed;

FIG. 3 is a view in perspective corresponding to the perspective view of FIG. 1 but showing one part of the carton open;

FIG. 4 is a plan view of the collapsed carton showing in dotted lines the disposition of the elements during collapse;

FIG. 5 is a cross-sectional view taken on line 5—5 of FIGS. 2 and 7 looking in the direction of the arrows;

FIG. 6 is a cross-sectional view taken on line 6—6 of FIG. 5 looking in the direction of the arrows;

FIG. 7 is a cross-sectional view taken on line 7—7 of FIG. 5 looking in the direction of the arrows.

Figure 8:
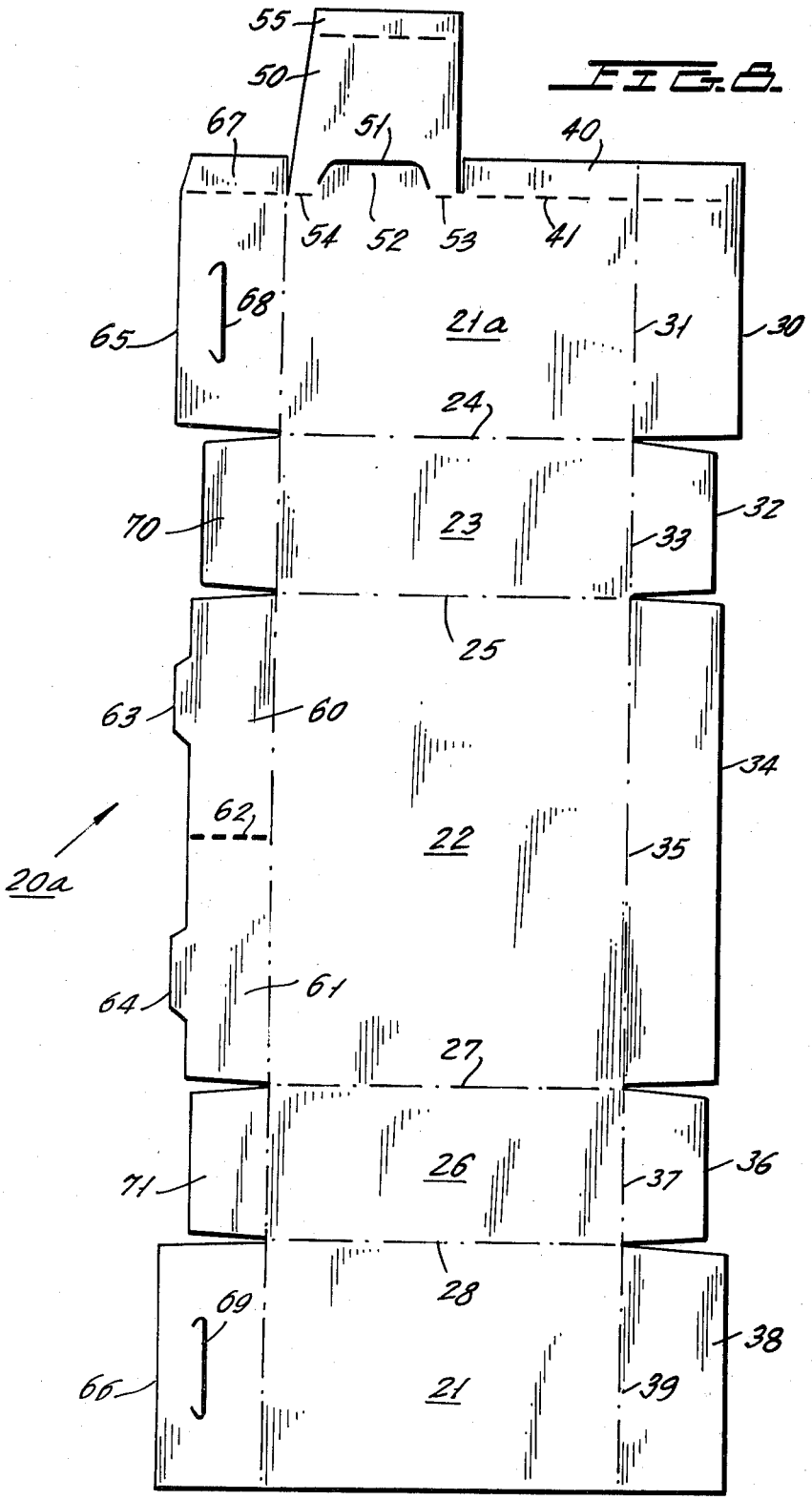
FIG. 8 is a plan view of the blank for forming the carton of FIGS. 1 through 7.

Referring to the drawings, there is shown in FIGS. 1 through 7 the carton 20 formed by the utilization of the blank 20*a* of FIG. 8. The carton consists of a back wall which is formed by the corresponding panels 21, 21*a* of the blank; a front wall 22; a side wall 23 connected by fold lines 24 to panel 21*a* of the back wall and by fold line 25 to the front wall 22 and another side wall 26 connected by the fold line 27 to the front wall 22 and by the fold line 28 to panel 21 of the back wall.

The bottom of the container comprises the panel 30 connected by fold line 31 to panel 21*a* of the back wall; panel 32 connected by fold line 33 to the end wall 23; panel 34 connected by fold line 35 to the front wall 22 of the carton; panel 36 connected by fold line 37 to the end wall 26 and panel 38 connected by fold line 39 to panel 21 of the back wall. It will be noted that in the blank of FIG. 8, panel 21*a* of the back wall has an adhesive extension 40. The extension 40 may receive adhesive on the side which, when the blank is folded up into the carton of FIG. 1, will extend on the inside of panel 21 of the back wall whereby the panel 21 will terminate at the mid line of the back wall of the carton. Hence, the extension 40 will be adhesively secured at the inside of the back wall panel 21 forming the seam at 41. A partition or divider panel 50 extends from the same edge of the panel 21*a*, being, however, cut along the line 51 to provide a tab 52 which will also constitute a glue tab securable to the back wall panel 21. The divider panel 50 is hingedly secured at the mid line of the back wall by the two fold lines 53, 54 to the edge of the panel 21*a* from which the glue flap extends and the divider panel 50 may then be folded across as shown in FIGS. 1 and 7 and is provided with an additional adhesive panel 55 which is adhesively secured to the interior of the front wall 22 in the manner shown in FIGS. 1 and 7.

It will be noted that when the blank of FIG. 8 is formed, the application of adhesive to the extension 40 of panel 21*a* and to a surface of the extension 52 which is also secured to the inner surface of back wall panel 21 and the application of adhesive to the glue panel 55 may all be made on the same surface of the blank prior to its being folded up to the completed form. This completed tubular form, in collapsed condition is shown in FIG. 4. Thereafter, the bottom is sealed by closing the panels 30, 32, 34, 36, 38 in a manner now well known in the art and the top is left open so that the carton may be filled.

The top of the front wall 22 has a pair of closure flaps 60, 61 extending therefrom. These closure flaps may initially be a single unit separated by the break line 62. The closure flaps are provided with closing tabs 63, 64. The back wall has a pair of closing panels 65, 66 extending therefrom which are integrated by glue tab 67 which, in effect, is an interrupted extension of the glue area 40. The panel 65-66 extending from the front wall is provided with tab receiving slots 68, 69 to receive the closure tabs 63, 64 which may be inserted therein in the manner indicated in FIGS. 2, 3 and 5 to close the container. The dust flaps 70, 71 on the respective end walls 23 and 26 are, of course, folded in to act as further dust excluding closures prior to the folding down of the top wall section 65, 66 and the subsequent insertion into the slots 68, 69 thereof of the tabs 63, 64 of the top wall 60, 61.

It may be seen, particularly from FIG. 3, that the carton may now be opened by removing one of the tabs 63 of, for instance, the closure 60 from the corresponding slot 68 and holding the left-hand closure member 61 down while the right-hand closure member 60 is lifted up so that the closures will separate along the separation line 62 if it is desired to open only one of the two compartments. Obviously, the lids 60, 61 may be opened as a unit if both compartments are to be made immediately accessible.

It will be readily appreciated that the carton of this invention eliminates the need for excess material in the blank, while still forming an integral divider panel extending from one end of the blank. The material savings is accomplished by stepping the divider panel hinge back from the edge of the glue seam of the carton and cutting a glue tab from the divider panel, which glue tab forms a part of the carton glue seam.

In the foregoing, the present invention is described in connection with a preferred illustrative embodiment thereof. Since many variations and modifications of the present invention will now be obvious to those skilled in the art, it is preferred that the scope of this invention be determined not by the specific disclosures herein contained, but only by the appended claims.

What is claimed is:

1. A collapsible and erectable carton having a front wall, a back wall, and a pair of side walls interconnecting the front and back walls, said carton being in tubular form and formed from a single blank whose opposite edges are overlapped to form a medial seam traversing one of said front and back walls from top to bottom thereof;

said one of said front and back walls comprising two panels joined at said medial seam with the outermost one of said two panels terminating at the mid line of said one of said front and back walls;

the innermost one of said two panels extending beyond said mid line of said one of said front and back walls to form a glue tab secured to the inner surface of said outermost one of said two panels;

a divider panel extending from an end of said innermost one of said two panels and foldably connected to said innermost one of said two panels along a fold line disposed along said mid line of said one of said front and back panels, said divider panel having a glue flap foldably connected to a terminal end of said divider panel with said glue flap being adhesively secured to a medial portion of the inner surface of the other of said front and back walls; and a portion of said glue tab being formed by material cut from said divider panel and extending beyond said fold line of said divider panel and adhesively secured to said inner surface of said outermost one of said two panels.

2. The collapsible and erectable carton of claim 1, wherein one of the front or back walls has an outer lid extending therefrom with securement tabs extending from said outer lid and the opposite wall has a corresponding inner lid foldable below said outer lid and having slots located to receive the securement tabs of said outer lid, said inner and outer lids being divided by a medial rupturable line into two halves, there being one tab and a cooperating slot disposed in each half of said inner and outer lids.

* * * * *